US005083527A

United States Patent [19]

Naruse

[11] Patent Number: 5,083,527

[45] Date of Patent: Jan. 28, 1992

[54] COATING APPARATUS AND COATING ROD

[75] Inventor: Yasuhito Naruse, Shizuoka, Japan

[73] Assignee: Fuji Photo Film Co., Ltd., Kanagawa, Japan

[21] Appl. No.: 680,000

[22] Filed: Apr. 1, 1991

Related U.S. Application Data

[63] Continuation of Ser. No. 144,983, Jan. 19, 1988, abandoned.

[30] Foreign Application Priority Data

Jan. 19, 1987 [JP] Japan ..... 62-4959

[51] Int. Cl.[5] ..... B05C 3/00

[52] U.S. Cl. ..... 118/414; 118/119

[58] Field of Search ..... 118/119, 414, 118, DIG. 15; 29/132

[56] References Cited

U.S. PATENT DOCUMENTS

| | | | |
|---|---|---|---|
| 3,179,083 | 4/1965 | Warner | 118/119 X |
| 4,263,870 | 4/1981 | Saito et al. | 118/258 X |
| 4,521,459 | 6/1985 | Takeda | 118/119 X |

*Primary Examiner*—Shrive Beck
*Assistant Examiner*—Alain Bashore
*Attorney, Agent, or Firm*—Sughrue, Mion, Zinn, Macpeak & Seas

[57] ABSTRACT

A coating apparatus and a coating rod for use in a coating apparatus with which a very thin film coating can be formed with neither stripes nor repelling of the coating liquid and with an apparatus of reduced overall size. The coating rod is formed from a cylindrical base member, made of a material such as stainless steel, iron or brass, having a smooth surface with no wire wound thereon. In accordance with the invention, the surface of the rod is subjected to a nitrifying process.

9 Claims, 1 Drawing Sheet

COATING APPARATUS AND COATING ROD

This is a continuation of application Ser. No. 07/144,983 filed Jan. 19, 1988 now abandoned.

BACKGROUND OF THE INVENTION

The present invention relates to an apparatus for applying a coating liquid to a belt-like support (web) while the support in continuously moving. More particularly, the invention relates to an improved coating rod used in a coating apparatus.

Various apparatuses have been known for applying a coating liquid to a continuously travelling web. Such apparatuses generally employ a step (referred to as an application system) in which the coating liquid is transferred to the web and a step (referred to as a metering system) in which the coating liquid transferred to web is metered so as to obtain a desired coating thickness.

Coating methods are generally grouped and classified on the basis of differences in the application system and the metering system employed. Known application systems include a roller coating method, a dip coating method, and a fountain coating method. Known metering systems include an air-knife coating method, a blade coating method, and a rod coating method.

In the rod coating method, an excess quantity of the coating liquid is transferred to the web, and the surplus coating liquid is removed by a stationary or rotating rod, thereby to obtain a desired quantity of coating liquid on the web. The rod coating method is widely used due to the advantage that a thin-film coating can be effected at a high speed using a simple coating apparatus structure and employing a simple operation. Substantially any application system can be used with the rod coating method. However, the roller coating method, particulary a roller coating method known as the "kiss-roller" coating method, is most generally used because of its simplicity.

In the conventional rod coating method, however, the application and metering systems are performed completely separately from one another. This is disadvantageous in that the conditions for the two systems must be set entirely separately from one another, thereby making the overall coating operation complex. Also, the overall coating apparatus requires a substantially large installation space, reducing the economy of the operation.

A coating apparatus has been proposed, for example, in Japanese Patent Publication No. 36529/1977, in which a physical space is mechanically formed in a formed by closely winding a wire around the surface of a rod (hereinafter, referred to as a "wire bar") portion by a coating applicator, a heat-resistant filler, and a thin guide plate so as to form a wedge-like liquid well. Also, a coating apparatus has been disclosed in U.S. Pat. No. 4,263,870 in which a bar coating process for coating a coating liquid on a continuously travelling web which comprises the steps of supplying a coating liquid so as to form a liquid reservoir immediately before a position of contact between a bar and the web, and coating the coating liquids on the web using the bar, wherein the bar is axially positioned perpendicularly to the travelling direction of the web; is supported on a supporting member and is rotated in the same direction as that of the web while coming into contact with the web. These two apparatuses are improved over the earlier coating apparatuses in that their operation is made easier, no large installation space is required, and a coating film having superior surface properties can be formed.

On the other hand, in these apparatuses adjustment of the quantity of the applied coating liquid is performed by changing the diameter of the wire on the coating rod, the wire being wound around an inner cylindrical base member of the rod. To reduce the amount of coating liquid, the diameter of the wire is reduced. However, from the viewpoint of manufacturing accuracy and durability, there is a lower limit to the wire diameter, thus making it very difficult to form a very thin coating layer. Also, the wire has a tendency to wear or suffer damage over time, thereby generating undesirable variations or faults in the coated layer.

SUMMARY OF THE INVENTION

A primary object of the present invention is to eliminate the above-mentioned drawbacks of the prior art.

More particularly, it is an object of the present invention to provide an improved coating rod for use in a coating apparatus with which variations in coating thickness and faults in the coated layer surface are substantially reduced, no wire is used in the coating rod, and with which a very small coating thickness can be obtained.

In accordance with the above and other objects, in the coating apparatus and rod of the present invention, a coating rod having no wire wound thereon is used, and instead a nitrifying-processed surface is employed.

DESCRIPTION OF THE PREFERRED EMBODIMENTS

Figure 1:
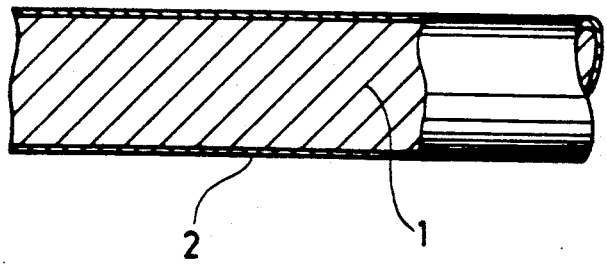
FIG. 1 is a longitudinal sectional view showing a coating rod having a nitrified layer surface according to the present invention.
Figure 2:
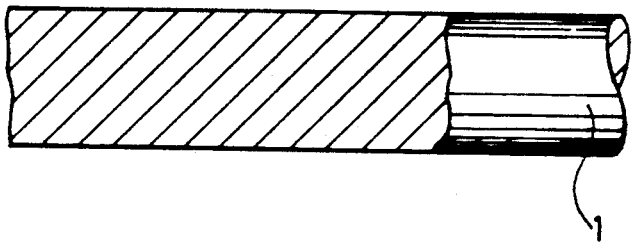
FIG. 2 is a longitudinal sectional view showing a conventional rod used in a coating apparatus.

FIG. 1 is a longitudinal sectional view of a coating rod having a nitrified surface layer used in a coating apparatus of the present invention, and FIG. 2 is a similar view of a conventional rod for comparison purposes. In both FIGS. 1 and 2, reference numeral 1 designates a cylindrical rod base, and reference numeral 2 designates a nitrified layer formed on the rod base 1 by surface processing.

Suitable examples of the material for the rod base 1 include stainless steel, iron, brass, and the like.

The rod base 1 is first processed by grinding its outer circumferential surface to a smooth finish by moving a grinding jig in the axial direction of the rod base 1.

Subsequently, to form the nitrified layer on the surface of the rod base 1, an ion nitrifying method is employed. A nitrified layer can readily be formed in this manner because the oxidized layer on the surface of the rod base 1 can be removed using a sputtering action. It is desirable also to perform preprocessing using a halogen compound, for example, by application of hydrochloric acid or the like.

Figure 3:
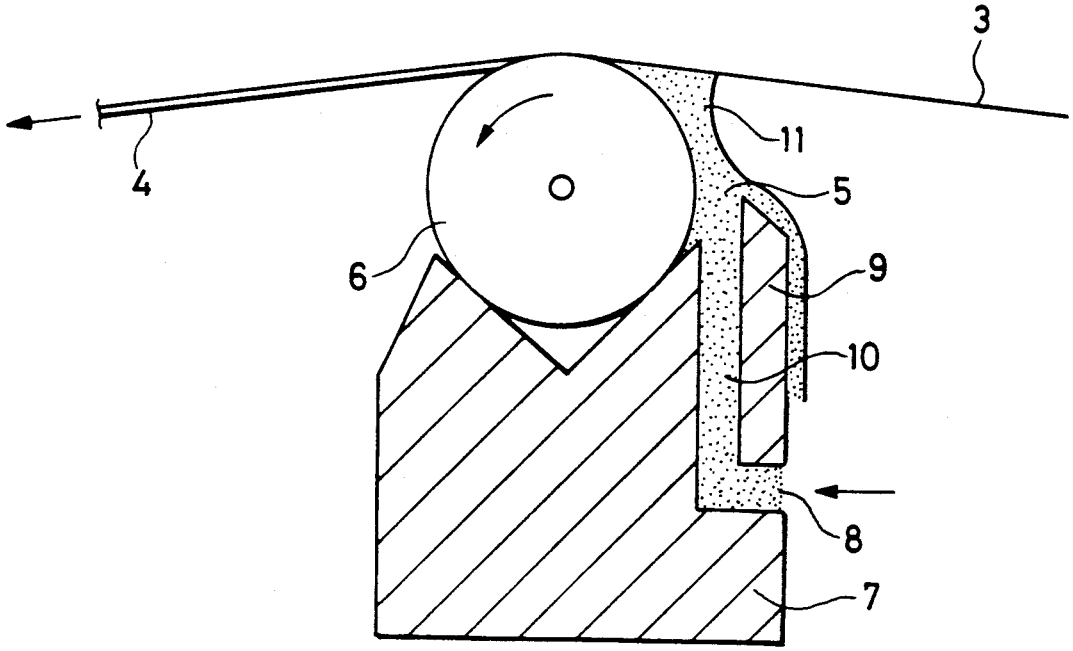
FIG. 3 is a schematic sectional view of a rod coating apparatus constructed according to the present invention.

Referring now to FIG. 3, which illustrates schematically a rod coating apparatus in accordance with the present invention, a rod 6, axially perpendicular to the direction of travel of the web, is rotated in the same direction as that of continuously travelling web 3. A rod supporting member 7 is extended over the full length of the rod 6 to prevent the rod 6 from deflecting and to serve as a liquid supply means for supplying coating liquid 5 to the rod 6. That is, the coating liquid 5 is supplied from a liquid supply port 8 provided in the rod supporting member 7 into a groove 10 for guiding the liquid formed between the bar supporting member and a weir member 9 and are picked up by the rotating rod to be coated onto the web 3. In this case, the coating liquid 3 is metered at a contact portion between the web 3 and the rod 6 and only the desired amount of coating liquid is coated on the web 3, whereas the remaining liquid flows down to form a liquid reservoir 11 together with coating liquid 5 newly supplied. In a steady state, therefore, the coating liquid 5 is coated on the web 3 through the liquid reservoir 11.

Moreover, because the rod 6 both transfers and applies the coating liquid 5 and meters the applied coating liquid 5 to the desired amount, the overall apparatus can readily be made more compact, thereby making it possible to more effectively use the available space. Also, the coating conditions for both application and metering can simultaneously be set.

It should of course be understood that the coating rod of the present invention can also be used in a conventional apparatus, for example, to replace the metering rod in the conventional apparatus.

The coating liquid used with the inventive coating rod and coating apparatus is not particularly limited. Suitable coating liquids include, for example, aqueous solutions, organic solvent solutions of high molecular compounds, pigment dispersed solutions, and colloidal solutions. Although the physical properties of the coating liquid are not specifically limited, it is preferable to use a coating liquid having a low viscosity of 100 cp or less, more preferably, 10 cp or less. Moreover, although the surface tension of the coating is also not specifically limited, a particularly desirable effect can be obtained if the surface tension is selected to be 50 dyne/cm or less.

Examples of web materials which are suitable for use with the present invention include paper, plastic film, resin-coated paper, aluminum, and synthetic paper. In the case of plastic film, suitable examples include polyolefins such as polyethylene and polypropylene vinyl, polymers such a polyvinyl acetate, polyvinyl chloride, and polystrene, polyamides such as 6,6-nylon and 6-nylon, polyesters such as polyethylene terephthalate and polyethylene 2,6-naphthalate, and cellulose acetates such as polycarbonate, cellulose triacetate, and cellulose diacetate. In the case of resin-coated paper, the resin used to coat the paper may be a polyolefin such as polyethylene or the like, but of course the invention is not limited to this particular example.

The thickness of the web, although not particularly limited, may be advantageously selected within a range of about 0.01 to 1.0 mm for general use.

According to the present invention, it becomes possible to stably perform coating at a considerable small thickness using a coating rod having a generally smooth surface and without using wire wound on the surface of the rod. The surface of the coating rod of the invention is subjected to a nitrifying process. If the surface of the rod is smooth but not subjected to such treatment, scratch of the rod surface can easily occur due to the presence of dust particles or other foreign matter conveyed on the web or contained in the coating liquid, thereby causing surface defects such as stripes; repelling of coating liquid or the like. However, by nitrifying the surface of the rod in accordance with the present invention, scarring of the rod surface is positively prevented, thus maintaining a uniform and faultless film thickness.

A specific example of the invention and a comparative example will now be described.

EXAMPLE OF THE INVENTION

Using a rod coating apparatus as shown in FIG. 3, an aluminum web having a thickness of 300 μm and a width of 500 mm has continuously travel, and a coating liquid (A) having the following composition was applied, using a coating rod having a nitrifying-processed surface, to a surface of the web, which had been roughened with an abrasive in advance:

| COATING LIQUID (A) | |
|---|---|
| Phenol resin | 3 part by weight |
| Ethylene glyclol monomethyl ether | 20 parts by weight |
| Methylethylketone | 80 parts by weight |

With the invention employing this composition for the coating liquid, neither stripes nor spots was observed on the surface of the web. The amount of the coating was found to be 1.5 $cc/m^2$ using a spectral absorbtion method based on the chloric group contained in the phenol resin.

COMPARATIVE EXAMPLE

The same coating liquid (A) as employed in the example of the invention was coated onto the same type web using a rod of SUS304. Stripes were observed in the coated surface.

According to the present invention, the coating rod used for applying the coating liquid to a continuously travelling web is constructed of a cylindrical base member having a smooth surface which has been subjected to a nitrifying process. No wire is provided on the surface of the rod. Thus, with the invention the occurrence of faults on the surface of the coated web are remarkably reduced while coatings of a very small thickness can be obtained.

What is claimed is:

1. In a coating rod for use in a coating apparatus for uniformly applying a coating liquid to a continuously traveling web while in contact with a surface of said web and for controlling the amount of coating applied thereto, the improvement wherein said rod is wireless and is formed from a cylindrical base member having a smooth surface which has been subjected to nitrifying processing.

2. The coating rod of claim 1, wherein said coating rod is formed of a material selected from the group consisting of stainless steel, iron and brass.

3. The coating rod of claim 1, wherein said nitrifying process is an ion nitrifying process.

4. A coating apparatus comprising: a wireless coating rod, said rod being formed from a cylindrical base member having a smooth surface which has been subjected to nitrifying processing, a web to be coated passing above said rod, said rod contacting said web; a rod support member disposed below said rod and supporting said rod in a generally V-shaped groove formed in an upper side of said rod support member in such a manner as to prevent said rod from bending; and a weir member disposed adjacent a side of said rod support member and below a surface of said web on an upstream side of said rod, a liquid supply groove being formed between said rod support member and said weir member for supplying a coating liquid to said surface of said rod, a liquid reservoir of said coating liquid being formed above said rod while said web is travelling, wherein said coating rod uniformly applies the coating liquid to said web and controls the amount of coating applied thereto.

5. The coating apparatus of claim 4, wherein said coating rod is formed of a material selected from the group consisting of stainless steel, iron and brass

6. The coating apparatus of claim 1, wherein said nitrifying process is an ion nitrifying process.

7. The coating apparatus of claim 4, wherein said coating liquid has a viscosity of 100 cp or less.

8. The coating apparatus of claim 4, wherein said coating apparatus has a viscosity of 10 cp or less

9. The coating apparatus of claim 4, wherein a surface tension of said coating liquid is 50 dyne/cm or less.

* * * * *